United States Patent [19]

Merker, Jr.

[11] Patent Number: 4,793,720

[45] Date of Patent: Dec. 27, 1988

[54] RAILWAY CAR RESILIENT SIDE BEARING

[75] Inventor: Walter H. Merker, Jr., Downers Grove, Ill.

[73] Assignee: American Standard Inc., Chicago, Ill.

[21] Appl. No.: 146,663

[22] Filed: Jan. 21, 1988

[51] Int. Cl.[4] ..... F16C 17/04

[52] U.S. Cl. ..... 384/423; 384/220; 384/448

[58] Field of Search ..... 384/423, 597, 448, 420, 384/220

[56] References Cited

U.S. PATENT DOCUMENTS

| | | | |
|---|---|---|---|
| 1,718,217 | 6/1929 | Crawford | 384/597 |
| 2,913,288 | 11/1959 | Blattner | 384/423 |
| 3,712,691 | 1/1973 | Cope | 384/423 |
| 3,957,318 | 5/1976 | Wiebe | 384/423 |

*Primary Examiner*—Lenard A. Footland
*Attorney, Agent, or Firm*—J. O. Ray, Jr.

[57] ABSTRACT

This invention provides a railway car resilient side bearing assembly which includes a housing member with a cavity formed therein. A first substantial portion of a resilient spring block is positioned within the cavity of the housing member. There is at least one aperture formed in each end of the spring block. A friction head member is provided which has a cavity therein that surrounds a second portion of the spring block. An at least one peg member is secured substantially perpendicular to and substantially at a geometric center of each of an upper surface of a base portion of the housing member and a lower surface of the plate portion of the friction head member which engages a respective one of the at least one aperture in each end of the spring block to maintain the resilient side bearing assembly together. A height indicator is provided on the resilient side bearing assembly for indicating the nominal height of usch resilient side bearing assembly after installation.

30 Claims, 4 Drawing Sheets

RAILWAY CAR RESILIENT SIDE BEARING

FIELD OF THE INVENTION

The present invention relates, in general, to constant contact side bearing assemblies which provide supplemental support between the car body and the truck of a railway car and, more particularly, this invention relates to such a constant contact side bearing assembly which provides the constant contact side bearing assembly with an increased amount of pretravel.

BACKGROUND OF THE INVENTION

At the present time, there are a number of railroad equipment manufacturers which provide the railroad industry with "metal to metal" type rubbing constant contact side bearing assemblies. These constant contact side bearing assemblies must meet the American Association of Railroads (AAR) specification (M-948-79) dated Apr. 4, 1984, and published in the Manual of Standards and Recommended practices. The teachings in this specification are incorporated herein by reference thereto. These constant contact side bearing assemblies are also recognized in the railroad art as resilient side bearings. The term resilient side bearing assembly will be used hereinafter in the description of the invention.

According to the above-referenced specification, the function of the resilient side bearing assembly is to act as a resilient or constant supplemental support between the car body and truck, and offer the means for transmitting car body rocking forces into the truck system throughout a truck swivel range of eleven degrees in either direction.

In order to accomplish this function, the resilient side bearing must operate within the five and one-sixteenth inch nominal working height between the truck bolster and the body side bearing wear plate secured to the underside of the car body. This side bearing wear plate is located two feet-one inch from the center line of the car. In addition, the resilient side bearing must having the capacity to sustain, without permanent deformation, impact (rocking) forces equal to the vertical side bearing load P times a constant. This constant is 1.43. Furthermore, the resilient side bearing assembly must be secured to the truck bolster and be able to withstand a design shear force equal to $P \times 1.43 \times$ the coefficient of friction. In recovery from deformation, vertical force and contact must not be lost.

It is also a requirement that the resilient side bearing assembly preload must be equally distributed and its torsional resistance, when combined with the resistance of the center plate and any other devices with which the car may be equipped, must not interfere with the ability of the car to negotiate the minimum radius curve for which it is designed.

In this specification, the term "pretravel" of a resilient side bearing assembly is the travel from the free height to the five and one-sixteenth inc installed height. As the car sways from side to side, the bearing on the car's high side could have as much as an eleven-sixteenth inch increase in height. Although it is desirable for the friction head portion of the resilient side bearing assembly to stay in contact with the car body wear plate, it is difficult t achieve this amount of pretravel with the resilient side bearings of the prior art of which applicant is aware.

One such resilient side bearing is marketed by Miner Enterprises, Inc. under the tradename Tecs Pac. This resilient side bearing assembly consists of three parts: a metal housing and a metal cap attached to an elastomer pad. The A. Stucki Company also provides a resilient side bearing assembly. This resilient side bearing assembly also consists of: a metal housing and a metal cap with resilient elements having sloped upper surfaces into which are keyed mating sloped surfaces of a corresponding metal cap. This inclined interface between the resilient elements and the metal cap provides a wedging action which eliminates the longitudinal force motion in the assembly. A steel roll is disposed between the resilient elements, and a pair of hardened steel end closures are used to close the cage and openings and to contain the resilient elements.

The resilient element in the Miner resilient side bearing assembly is a Hytrel elastomer, manufactured by the DuPont Company, while the Stucki resilient side bearing assembly utilizes urethane for these resilient elements.

SUMMARY OF THE INVENTION

The present invention provides a railway car resilient side bearing assembly which serves a dual purpose when installed on such railway car. The first purpose is to provide a supplemental support between the car body portion and the truck portion of such railway car, and the second purpose is to provide a means of transmitting such car body portion rocking forces to a spring system that is mounted on the truck portion of the railway car. The railway car resilient side bearing assembly of the present invention comprises a housing member which includes a base portion and an upstanding body portion. The upstanding body portion is secured to an upper surface of the base portion of such housing member. The base portion has a bottom surface, disposed axially opposite the upper surface, which engages the truck portion during service of such resilient side bearing assembly on the railway car. The upstanding body portion extends upwardly from the upper surface of the base portion a predetermined distance and forms a cavity in such housing member. The cavity has a preferred cross-sectional shape that is predetermined. The resilient side bearing assembly also includes a resilient spring block. At least a first substantial portion of the resilient spring block is disposed within the cavity of the housing member in a position such that a lower surface of the resilient spring block will be in abutting engagement with a predetermined portion of the upper surface of such base portion of the housing member. The resilient spring block has both a predetermined length and a predetermined cross-sectional shape. The cross-sectional shape of the resilient spring block is substantially identical to the predetermined cross-sectional shape of the cavity in the housing member. Further, such resilient spring block includes a convexly-tapered portion adjacent each of an upper surface and the lower surface of such resilient spring block. These convexly-tapered portions of the resilient spring block have a predetermined taper. The resilient spring block provides the resilient side bearing assembly with a predetermined amount of preload so that a required installed height of such resilient side bearing assembly on the truck portion of the railway car can be achieved. An at least one aperture is provided in each end of such resilient spring block. These apertures are positioned substantially in axial alignment with a longitudinal centerline of the resilient spring block. Each of such at least one aperture in such each end of the resilient spring block has a predetermined length and a predetermined cross-sectional shape. The resilient side bearing assembly further includes a friction head member. The friction head member has a plate portion and a downwardly extending rim portion which is secured to the plate portion. The plate portion includes an upper friction surface which frictionally engages a wear plate that is secured to an underside of the body portion of the railway car, and a lower surface disposed axially opposite the upper friction surface. Additionally, the plate portion of the friction head member has a predetermined shape which ensures that a substantial portion of the upper friction surface will remain in frictional engagement with a friction surface of the wear plate during angling of the truck portion of the railway car. At least a predetermined portion of such lower surface of the plate portion is positioned to abuttingly engage the upper surface of the resilient spring block. The downwardly extending rim portion of the friction head member extends downwardly from the lower surface of the plate portion for a predetermined distance and forms a cavity in such friction head member. The cavity in the friction head member surrounds a second portion of the resilient spring block adjacent its upper surface. In addition, the cavity in the friction head member has a predetermined cross-sectional shape which is substantially identical to the predetermined cross-sectional shape of both the cavity on the housing member and on the resilient spring block. The downwardly extending rim portion is positioned for reciprocal movement within the cavity of the housing member of such resilient side bearing assembly. The resilient side bearing assembly also includes an at least one peg means which is secured substantially perpendicular to and substantially at the geometric center of each of the upper surface of the base portion of the housing member and the lower surface of the plate portion of such friction head member. Each of the at least one peg means will engage a respective one of the at least one aperture in such each end of the resilient spring block, thereby maintaining the resilient side bearing assembly together during shipment and installation on such truck portion of the railway car Each of the at least one peg means has a predetermined length and a predetermined cross-sectional shape. The predetermined cross-sectional shape of such each one of the peg means is substantially identical to the predetermined cross-sectional shape o the at least one aperture disposed in such each end of the resilient spring block. The final essential component of the resilient side bearing assembly of this invention is an indicator means for indicating a nominal working height of the resilient side bearing assembly after such resilient side bearing assembly has been installed on the truck portion of the railway car. A first portion of the indicator means is positioned on the friction head member while a second portion of such indicator means is positioned on the housing member of the resilient side bearing assembly.

OBJECTS OF THE INVENTION

It is, therefore, one of the primary objects of the present invention to provide a resilient side bearing assembly for use on a railway car which includes a cone-shaped means positioned within both the friction head and the housing member for the elastomer spring block to bear against, thereby providing an increased pretravel distance of such resilient side bearing assembly.

Another object of the present invention is to provide a railway car resilient side bearing assembly in which pins are used to form the cone-shape means in the friction head and the housing member, and such pins are slightly longer than a corresponding cavity formed in the elastomer spring block, thereby providing a further increase in the pretravel distance of such resilient side bearing assembly.

A further object of the present invention is to provide a railway car resilient side bearing assembly in which the cavities formed in the elastomer spring block are made slightly smaller than a corresponding cone-shaped means, thereby providing a force fit of an amount which is at least sufficient to ensure the resilient side bearing assembly will remain in an assembled relationship during shipment and installation.

An additional object of the present invention is to provide a railway car side bearing assembly in which the pretravel distance of such resilient side bearing assembly can be increased still further by providing an elastomer spring block which includes tapered end portions of a predetermined taper.

Still another object of the present invention is to provide a railway car resilient side bearing assembly in which the friction head geometry is designed such that, at least theoretically, a one hundred percent contact is maintained between such friction head and the body wear plate during angling, thus ensuring a constant rotational torque resistance during operation of such railway car.

Yet a further object of the present invention is to provide a railway car resilient side bearing assembly in which the housing member for the elastomer spring block includes means formed therein which allows moisture to drain freely while, at the same time, the end means to drain the moisture does not interfere with the ability of the housing member to transmit the compressive loading of the elastomer spring block and the oversolid loads of the friction head to the truck bolster of such railway car.

It is an additional object of the present invention to provide a railway car resilient side bearing assembly in which a means is cast into a tongue portion of the friction head that fits into a slot formed in the housing member and serves the dual purpose of first, indicating the proper nominal installation height of such resilient side bearing assembly, and second, satisfying the requirement of non-interchangeability which prevents the misapplication of similar components that would cause a resilient side bearing assembly to be assembled which would fail to meet a maximum rotational torque and a maximum side bearing preload for the intended railway car.

Still yet another object of the present invention is to provide a railway car resilient side bearing assembly in which the end load of the elastomer spring block is about double the preload on such elastomer spring block at the installed height of such resilient side bearing assembly.

In addition to the above-described objects and advantages of the railway car resilient side bearing assembly, according to the present invention, various other objects and advantages of the invention will become more readily apparent to those persons who are skilled in the railway car resilient side bearing art from the following more detailed description of the present invention, when such description is taken in conjunction with the attached drawing FIGURES and with the appended claims.

BRIEF DESCRIPTION OF THE DRAWINGS

FIG. 77 is a cross-sectional view, taken along the lines VII—VII, of the housing member illustrated in FIG. 6;

FIG. 8 is an enlarged fragmented view of the portion of FIG. 7 marked VIII, which shows the conical surface seat for the elastomer spring block of the resilient side bearing assembly of the present invention;

FIG. 9 is a top view which illustrates the geometry of a presently preferred friction head of the resilient side bearing assembly of the present invention;

FIG. 10 is a side elevational view of the friction head assembly illustrated in FIG. 9;

FIG. 11 is a cross-sectional view of the friction head assembly taken along lines XI—XI of FIG. 9;

FIG. 12 is a side elevational view of a presently preferred elastomer spring block for use in the resilient side bearing assembly of the present invention; and FIG. 13 is a layout which illustrates the frictional engaging surfaces of the friction head of the resilient side bearing assembly and the car body wear plate throughout an eleven degree swivel of the truck.

BRIEF DESCRIPTION OF THE INVENTION

Figure 1:
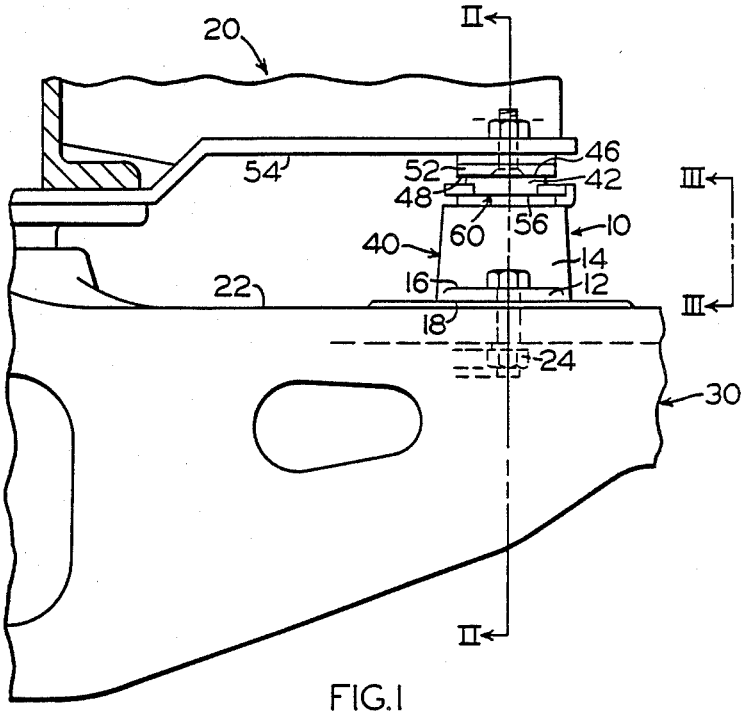
FIG. 1 is a fragmented elevational view which shows a side of a railway car truck bolster having a resilient side bearing assembly secured thereto and in bearing engagement with a wear plate secured to the underside of a car body.

Prior to proceeding to the detailed description of the invention, it should be noted that throughout the several views of the drawings that identical components forming a portion of the resilient side bearing assembly of the present invention have been identified with identical reference numerals.

Figure 2:
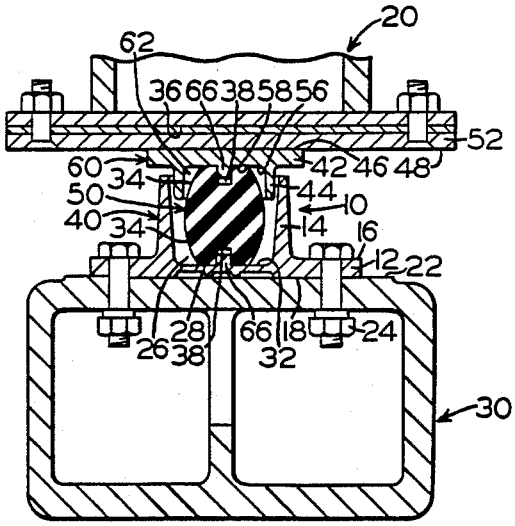
FIG. 2 is a cross-sectional view, taken along the line II—II of FIG. 1, which illustrates one presently preferred embodiment of the resilient side bearing assembly of the present invention.
Figure 3:
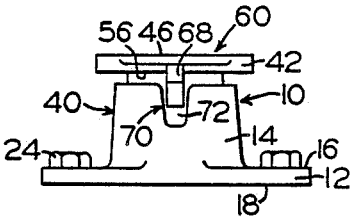
FIG. 3 is a side elevational view of the resilient side bearing assembly illustrated in FIG. 1, which shows a presently preferred means or indicating the installed height of such resilient side bearing assembly.
Figure 4:
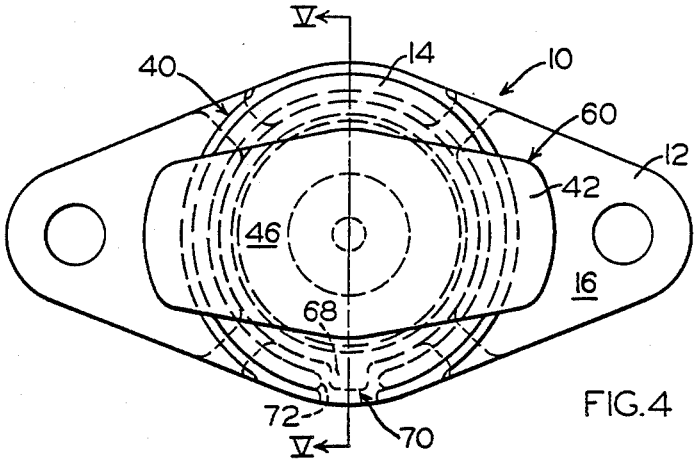
FIG. 4 is a top view of the resilient side bearing assembly of the present invention.

Now refer more particularly to FIGS. 1 through 3, which illustrate a railway car resilient side bearing assembly, generally designated 10. The resilient side bearing assembly 10 serves three primary functions during operation of the railway car on a track. The first of these functions is to provide a supplemental support between the car body portion, generally designated 20, and the truck portion, generally designated 30, of the railway car. The second of these functions is to provide a means for transmitting the car body portion 20 rocking forces into a spring system (not shown) that is mounted on the truck portion 30 of the railway car. The rocking forces of the car body portion 20 occur as such car body portion 20 sways back and forth during movement of the railway car over the track. The third function is that of attenuating truck hunting by frictional resistance between plate 52 attached to the car body 20 and the friction head 42 at surfaces 46 and 48.

The resilient side bearing assembly 10 includes a housing member, generally designated 40, which is illustrated in FIGS. 1–8. As shown therein, the housing member 40 includes a base portion 12 and an upstanding body portion 14. The upstanding body portion 14 is secured to an upper surface 16 of the base portion 12. In a presently preferred embodiment of the invention, the base portion 12 and the upstanding body portion 14 are formed as an integral casting. It is within the scope of the present invention, however, for the housing member 40 to be manufactured by other means, such as, by welding the upstanding body portion 14 to the base portion 12. The base portion 12 has a bottom surface 18, which is axially opposite the upper surface 16, engageable with and secured to an upper surface 22 of the truck portion 3 during service on the railway car. The resilient side bearing assembly 10 is, in the presently preferred embodiment of the invention, secured to the upper surface 22 of the truck portion 30 by bolting the base portion 12 of the housing member 40 to such upper surface 22 of the truck portion 30. Upstanding body portion 14 extends upwardly from the upper surface 16 of the base portion 12 for a predetermined distance and forms a cavity 26 in the housing member 40. In the presently preferred embodiment of the invention, the predetermined distance such upstanding body portion 14 extends upwardly from the upper surface 16 of the base portion 12 will be between about 3.40 inches to about 3.45 inches. The cavity 26, formed by the upstanding body portion 14, has a predetermined cross-sectional shape which, at present, is preferably generally cylindrical. It is also presently preferred that the wall surface of such cavity 26 will be tapered upwardly and outwardly from the upper surface 16 of the base portion 12.

Figure 5:
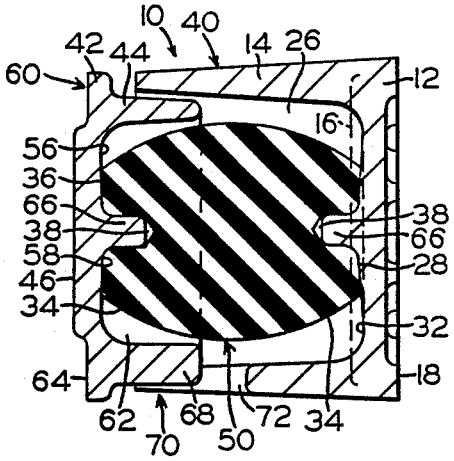
FIG. 5 is a cross-sectional view, taken along line V—V, of the resilient side bearing assembly illustrated in FIG. 4.
Figure 6:
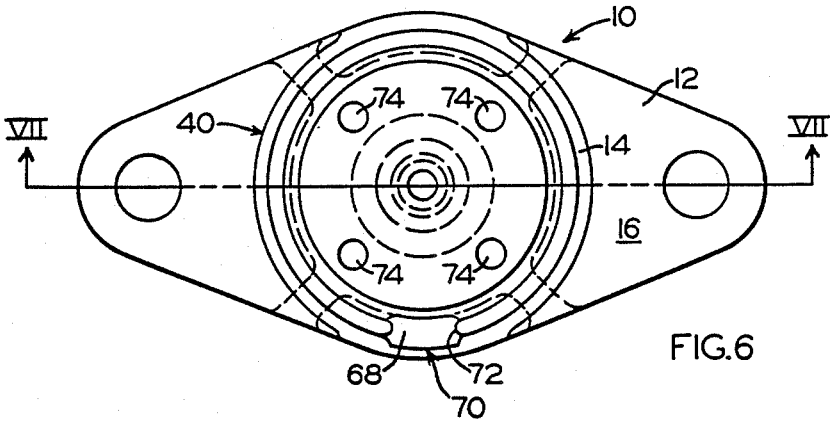
FIG. 6 is a top view of the housing member of a presently preferred embodiment of the resilient side bearing assembly of the present invention.

A second component of the resilient side bearing assembly 10 of the present invention is a resilient spring block, generally designated 50, which is illustrated in FIGS. 2, 5, and 12. In the presently preferred embodiment of the invention, this resilient spring block 50 will be an elastomer manufactured and sold by DuPont Company under the tradename Hytrel. At least a first substantial portion of the resilient spring block 50 is disposed within the cavity 26 of the housing member 40 in a position such that a lower surface 28 of such resilient spring block 50 abuttingly engages a predetermined portion 32 of the upper surface 16 of the base portion 12 of housing member 40. To provide an improvement in the pretravel of the resilient side bearing assembly 10 it is presently preferred that this predetermined portion 22 of the upper surface 16 will be disc-shaped with a diameter of generally about 2.00 inches. and that such disc-shaped predetermined portion 32 will taper outwardly and downwardly from the center of such predetermined portion 32 at an angle of generally about five degrees (FIG. 8). The resilient spring block 50 has a predetermined length and a predetermined cross-sectional shape which, in the presently preferred embodiment of the invention, is substantially identical to the predetermined cross-sectional shape of the cavity 26 in the housing member 40. i. e., generally cylindrical . By way of example only, for the standard 50, 70, and 100 ton cars, it is presently preferred that the predetermined length of such resilient spring block 50 will be in the range of from about 4.675 inches to about 4.757 inches. The most preferred length of the resilient spring block 50 is about 4.70 inches. As best seen in FIG. 12, the resilient spring block 50 includes a convexly-tapered portion 34 adjacent each of an upper surface 36 and a lower surface 28 of such resilient spring block 50. As mentioned above, for the standard 50, 70, and 100 ton cars. It is further presently preferred that the resilient spring block 50 will have a diameter of generally between about 3.045 inches and about 3.075 inches substantially midway between the upper surface 36 and the lower surface 28. The convexly-tapered portions 34 of the resilient spring block 50 will not only have a predetermined taper but all surfaces in these convexly-tapered portions 34 will be slightly convex. In the presently preferred embodiment of the invention. The resilient spring block 50 will provide a predetermined amount of preload to the resilient side bearing assembly 10 at an installed height on the truck portion 30 of the railway oar. Such predetermined amount of preload will generally be between about 2,000 pounds to about 7.500 grounds, with the most preferred range being between about 6,350 pounds to about 6,850 pounds for such 50, 70, and 100 ton cars. It should also be noted that the maximum bulge diameter at any point along the length of the resilient spring block 50 should not exceed about 3.50 inches at a compressed height of about 3.69 inches. There is at least one aperture 38 formed in each end of the resilient spring block 50. The centerline of the at least one aperture 38 in each end of the resilient spring block 50 is in substantial axial alignment with a longitudinal centerline of such resilient spring block 50. Each of the at least one aperture 38 in each end of the resilient spring block 50 has both a predetermined length and a predetermined cross-sectional shape. In the presently preferred embodiment, such predetermined length of the aperture 38 will generally be between about 0.61 inch to about 0.65 inch for such 50, 70, and 100 ton cars. The most preferred predetermined length is about 0.63 inch. The presently most preferred cross-sectional shape of the aperture 38 at each end of the resilient spring block 50 is generally cylindrical. The aperture 38 in this case will have a presently preferred diameter of between about 0.45 inch and about 0.49 inch, with he most preferred diameter being about 0.47 inch. In addition, it is preferred that for the lightweight and articulated cars, such diameters will be somewhat different in order to prevent interchangeability.

Another essential element of the resilient side bearing assembly 10 is a friction head member, generally designated 60. The friction head member 60 is illustrated in FIGS. 1–5 and 9–11. As illustrated therein, such friction head member 60 includes a plate portion 42 and a downwardly extending rim portion 44 secured to the plate portion 42. In the presently preferred embodiment of the invention. The plate portion 42 and the downwardly extending rim portion 44 are formed integrally as a casting; however, it remains in the scope of the invention if such downwardly extending rim portion 44 is secured to the plate portion 42 by other means, such as, by welding. The plate portion 42 of the friction head member 60 has an upper friction surface 46, which frictionally engages a wear surface 48 of a wear plate 52 that is secured to an underside 54 of the railway car body portion 20, and a lower surface 56 disposed axially opposite the upper friction surface 46. The plate portion 42 in the presently preferred embodiment of the invention has a predetermined shape which ensures that a substantial portion of the upper friction surface 46 remains in frictional engagement with the friction surface 48 of the wear plate 52 during angling of the truck portion 30 of the railway car. The substantial portion of the upper friction surface 46, which remains in frictional engagement with the friction surface 48 of the wear plate 52, will be at least about ninety-eight percent in the presently preferred embodiment. Theoretically, a one-hundred percent contact can be achieved with the resilient side bearing assembly 10 of the present invention. At least a predetermined portion 58 of the lower surface 56 of the plate portion 42 abuttingly engages the upper surface 36 of the resilient spring block 50. In order to achieve the improvement in the pretravel of the resilient side bearing assembly 10, it is presently preferred that this predetermined portion 58 of the lower surface 56 will be disc-shaped with a diameter of generally about 2.00 inches and that such disc-shaped predetermined portion 58 will taper outwardly and upwardly from the center of such predetermined portion 58 at an angle of generally about five degrees (FIG. 11). As can also be seen clearly in FIG. 11, the upper friction surface 46 of the plate portion 42 extends above another outer surface 64 for a predetermined distance, which is the range of between about 0.23 inch to about 0.27 inch. It is more preferred that the predetermined distance such upper friction surface 46 extends above such other outer surface 64 be generally about 0.25 inch. The downwardly extending rim portion 44 extends downwardly from the lower-most surface of the lower surface 56 of the plate portion 42 for a predetermined distance and forms a cavity 62 in the friction head member 60, which cavity 62 surrounds a second portion of the resilient spring block 50 adjacent the upper surface 36 thereof. The predetermined distance such downwardly extending rim portion extends downwardly from the lower-most surface is in the range of from about 1.54 inches to about 1.58 inches in the presently preferred embodiment of the invention. The cavity 62 that is formed in the friction head member 60 by the downwardly extending rim portion 44 has a predetermined cross-sectional shape which, in the presently preferred embodiment of the invention, is substantially identical to the predetermined cross-sectional shape of both the cavity 26 in the housing member 40 and the resilient spring block 50. i. e., generally cylindrical. In addition, the downwardly extending rim portion 44 is positioned for reciprocal movement over a predetermined distance within the cavity 26 in the housing member 40. Such reciprocal movement predetermined distance is generally between about 0.30 inch to about 0.455 inch.

Another important component of the resilient side bearing assembly 10, of the present invention, is an at least one peg means 66 secured substantially perpendicular to and substantially at the geometric center of the disc-shaped predetermined portion 32 of the upper surface 16 of the base portion 12 of the housing member 40, and another at least one peg means 66 which is secured substantially perpendicular to and substantially at the geometric center of the disc-shaped predetermined portion 58 of the lower surface 56 of the plate portion 42 of the friction head member 60. Each of the at least one peg means 66 frictionally engage a respective one of the at least one aperture 38 disposed in each end of the resilient spring block 50, and thereby maintains such resilient side bearing assembly in an assembled relationship during shipment and installation in such upper surface 22 of the truck portion 30 of such railway car. Each of the at least one peg means 66 has a predetermined length and a predetermined cross-sectional shape. In the presently preferred embodiment of the invention, the predetermined cross-sectional shape of each of the at least one peg means 66 will be substantially the same as the predetermined cross-sectional shape of the at least one aperture 38 located at each end of the resilient spring block 50. i. e., generally cylindrical. In order to further improve the pretravel of the resilient side bearing assembly 10, it is presently preferred that the predetermined length of each of the peg means 66 will be slightly longer than the predetermined length of each respective aperture 38 in the resilient spring block 50. It is presently preferred that this added length will be generally between about 0.060 inch and about 0.065 inch. It is likewise presently preferred that the diameter of each aperture 38 in each end of the resilient spring block 50 be slightly smaller than the diameter of each of a respective one of the peg means 66. In this manner, a force fit of the peg means 66 in the respective apertures is achieved and assists in maintaining such resilient side bearing assembly 10 in an assembled relationship. Such force fit will generally be between about 175 pounds to about 225 pounds in the presently preferred embodiment. This arrangement can also be used to prevent unintentional mixing of components for different weight capacity resilient side bearing assemblies which is an important consideration to the railroad industry. In the presently preferred embodiment of the invention, each of the peg means 66 is formed integrally with the respective one of the friction head member 60 and the housing member 40. However, it is within the scope of the claims directed to the present invention to secure such peg means 66 to such respective one of the housing member 40 and friction head member 60 by other means, such as, by welding or threading.

The final essential component of the resilient side bearing assembly 10 is an indicator means, generally designated 70, for indicating a nominal working height of such resilient side bearing assembly 10 after it has been installed on the upper surface 22 of the truck portion 30 of the railway car. Such indicator means 70 includes a first portion 68 which is positioned on the friction head member 60, and a second portion 72 which is positioned on the upstanding body portion 14 of the housing member 40. In the presently preferred embodiment of the invention, the first portion 68 of the indicator means 70 is a protruding member secured to the friction head member 60 and the second portion 72 of the indicator means 70 is a slot formed in a wall of the upstanding body portion 14 of the housing member 40. The protruding member 68 slides freely up and down in the slot 70.

Another feature provided in the presently preferred embodiment of the resilient side bearing assembly 10 is the provision of a drain means, generally designated 80. positioned in the base portion 12 of the housing member 40 which allows the moisture within the cavity 26 to drain freely. At the same time, such drain means 80 cannot interfere with the ability of the housing member 40 to transmit the compressive loading of the resilient spring block 50 and the oversolid loads of the friction head member 60 to the truck portion 30 of such railway car. The presently preferred drain means 80 includes a plurality of apertures 74, which are cast or drilled through the base portion 12 of the housing member 40, which lead to a plurality of channels formed in the bottom surface 18 of the base portion 12.

In summary, based upon the requirements of AAR Specification M-948-79, a resilient or constant contact side bearing assembly must have a preload at the installed five and one-sixteenth inch height of no more than eighty-five percent of one-fourth the car body light weight so that proper engagement of the car body and truck center plate is maintained at all times.

There are four general categories of car body light weights one of which encroaches upon another, i.e., standard 50 ton car body weight of 42,000 lbs. maximum and standard 70 ton and 100 ton car body weight of 40,000 lbs. minimum. Consequently, it is felt that three resilient side bearing assembly preloads of about 2,900 lbs., 4,100 lbs., and 6,000 lbs. will take care of all four categories as shown in Table I.

TABLE I

CAR BODY WEIGHT CATEGORIES VS. SIDE BEARING APPLICATION

| Stabilized Side Bearing Preload, Lbs. | Type of Car | Car Body Lt. Weight Lbs. | | Car Light Weight Lbs. | | Truck Weight Lbs. |
|---|---|---|---|---|---|---|
| | | Min. | Max. | Min. | Max | |
| 6,600 | Standard 100 Ton | 40,000 | 96,000 | 61,000 | 117,000 | 10,500 |
| 6,600 | Standard 70 Ton | 40,000 | 96,000 | 57,000 | 113,000 | 8,500 |
| 6,600 | Standard 50 Ton | 31,000 | 42,000 | 46,000 | 57,000 | 7,500 |
| 4,100 | Light-weight 100 Ton | 19,400 | 31,000 | 40,400 | 52,000 | 10,500 |
| 2,900 | Articu-lated Flats | 13,700 | 17,440 | 22,200 | 30,200 | 8,500 |

Prior to installing the resilient side bearing assembly 10, it may be necessary to shim the car body portion 20 wear. plate 52 per AAR Standard S-255-83 to achieve the installed height of five and one-sixteenth inch plus or minus one-sixteenth inch, as shown in FIG. 2, between such wear plate 52 and the upper surface 22 of the truck portion 30. When installing, the car should be empty, on level tangent track, and without solid center plate lubricant. If necessary, each individual space may range from five inches to five and one-quarter inches as long as each car end stays within a sum of ten inches to ten and one-quarter inches.

Recommended four inches wide car body portion 20 wear plate 52 lengths are as follows:

| Minimum Length | Truck Centers |
|---|---|
| 16" | Over 50' |
| 14" | 28' to 50' |
| 12" | Under 28' |

Fasten the resilient side bearing assembly 10 with $\frac{7}{8}$"-9 Grade 5, ASTM a-325, or equivalent bolts 24 facing the height indicator means 70 outboard. Us a standard heavy hex nut with spring lock washer, torqued dry to 430 1b.-ft. Secure by tack weld of nut to bolt. If lock nuts are used, obtain manufacturer's recommended torque value, which will obtain a 25,000 to 30,000 lbs. bolt 24 clamping force.

The alignment of the centerlines of the car body portion wearplate 52 to the resilient side bearing assembly 10 shall be plus or minus one-quarter inch longitudinally. Laterally, they shall be from on centerline up to a three-eighths inch offset of the resilient side bearing assembly 10 toward the wheel side of such railway car.

Removal of the resilient spring block 50 is required if the housing member 40 and/or friction load member 60 is heated for any purpose during installation, because prolonged temperatures above 175 degrees F. may degrade the resilient spring block 50 characteristics. It will require a pull somewhat in excess of 100 pounds to remove the resilient spring block 50. Care should be taken to properly reseat the resilient spring block 50 on its peg means 66 when reassembling into the housing member 40 after it has cooled.

Initial set time is a factor of temperature and it could take over 24 hours at 40 degrees F. for the resilient side bearing assembly 10 to reach the five and one-sixteenth inch nominal dimension, as shown on the height indicator means 70. Therefore, the above resilient spring block 50 removal procedure may also be used when the car construction area temperature is low. Keeping the resilient spring block 50 at normal room temperature for several hours should correct any set time problems or, alternatively, the entire resilient side bearing assembly 10 may be kept at room temperature prior to installing.

Care must be taken to protect the resilient side bearing assembly 10 from shot or grit blasting, including the friction head member 60 surface. It is recommended that the unit be applied after blasting.

While a presently preferred embodiment of the resilient side bearing assembly of the present invention has been described in detail above with reference to the numerous drawing FIGURES, it should be obvious to those persons skilled in the railway car resilient side bearing assembly art that other modifications and adaptations of this invention can be made without departing from the spirit and scope of the appended claims.

I claim:

1. A railway car resilient side bearing assembly which serves a dual purpose of first, providing a supplemental support between a car body portion and a truck portion of such railway car, and second, as a means of transmitting such car body portion rocking forces into a spring system that is mounted on such truck portion, said railway car resilient side bearing assembly comprising:

(a) a housing member which includes a base portion and an upstanding body portion secured to an upper surface of said base portion, said base portion having a bottom surface, disposed axially-opposite said upper surface, engageable with such truck portion, said upstanding body portion extends upwardly from said upper surface of said base portion a predetermined distance and forms a cavity in said housing member, said cavity having a predetermined cross-sectional shape;

(b) a resilient spring block having at least a first substantial portion thereof disposed within said cavity of said housing member in a position such that a lower surface of said resilient spring block abuttingly engages a predetermined portion of said upper surface of said base portion of said housing member, said resilient spring block having a predetermined length and a predetermined cross-sectional shape, said resilient spring block including a convexly-tapered portion adjacent each of an upper surface and said lower surface, said convexly-tapered portion having a predetermined taper, said resilient spring block providing a predetermined amount of preload to said resilient side bearing assembly at an installed height on such truck portion of such railway car;

(c) an at least one aperture formed in each end of said resilient spring block substantially in axial alignment with a longitudinal centerline of said resilient spring block, said at least one aperture in said each end of said resilient spring block having a predetermined length and a predetermined cross-sectional shape;

(d) a friction head member which includes a plate portion and a downwardly extending rim portion secured to said plate portion, said plate portion having an upper friction surface which frictionally engages a wear plate that is secured to an underside of such body portion of such railway car and a lower surface disposed axially opposite said upper friction surface, said upper friction surface of said plate portion having a predetermined shape which ensures that a substantial portion of said upper friction surface remains in frictional engagement with such wear plate during cycling of such truck portion of such railway car, at least a predetermined portion of said lower surface of said plate portion abuttingly engages said upper surface of said resilient spring block, said downwardly extending rim portion extends downwardly from said lower surface of said plate portion a predetermined distance and forms a cavity in said friction head member which surrounds a second portion of said resilient spring block adjacent said upper surface, said cavity in said friction head member having a predetermined cross-sectional shape, said downwardly extending rim portion is positioned for reciprocal movement within said cavity in said housing member;

(e) an at least one peg means, secured substantially perpendicular to and substantially at a geometric center of each of said upper surface of said base portion of said housing member and said lower surface of said plate portion of said friction head member, which engage a respective one of said at least one aperture in said each end of said resilient spring block for maintaining said resilient side bearing assembly together during shipment and installation on such truck portion of such railway car, each of said at least one peg means having a predetermined length and a predetermined cross-sectional shape; and (f) an indicator means having a first portion positioned on said friction head member and a second portion positioned on said housing member for indicating a nominal working height of said resilient side bearing assembly after such installation on such truck portion of such railway car.

2. A railway car resilient side bearing assembly. according to claim 1, wherein said predetermined cross-sectional shape of said cavity in said housing member is substantially identical to said predetermined cross-sectional shape of said cavity in said friction head member.

3. A railway car resilient side bearing assembly, according to claim 2, wherein said predetermined cross-sectional shape of said resilient spring block is substantially identical to said predetermined cross-sectional shape of both of said housing member and said friction head member.

4. A railway car resilient side bearing assembly, according to claim 3, wherein said predetermined cross-sectional shape of each of said cavity in said housing member and said cavity in said friction head member and said resilient spring block is generally cylindrical.

5. A railway car resilient side bearing assembly, according to claim 4 wherein said resilient spring block has a predetermined maximum bulge diameter at a predetermined compressed height.

6. A railway car resilient side bearing assembly. according to claim 5, wherein said predetermined maximum bulge diameter is not more than about 3.50 inches when said predetermined compressed height is between about 3.67 inches and about 3.71 inches.

7. A railway car resilient side bearing assembly, according to claim 6, wherein said predetermined amount of preload provided to said resilient side bearing assembly by said resilient spring block is between about 2,000 pounds and about 7,500 pounds.

8. A railway car resilient side bearing assembly, according to claim 7, wherein all tapered and end surfaces of said resilient spring block are slightly convex.

9. A railway car resilient side bearing assembly, according to claim 8, wherein such railway car is a standard 50 ton to 100 ton type car and said predetermined amount of preload is between about 5,700 pounds and about 7,500 pounds.

10. A railway car resilient side bearing assembly, according to claim 8, wherein such railway car is a 100 ton lightweight-type car and said predetermined amount of preload is between about 3,200 pounds and about 5,000 pounds.

11. A railway car resilient side bearing assembly, according to claim 8, wherein such railway car is an articulated flat-type car and said predetermined amount of preload is between about 2,000 pounds and about 3,800 pounds.

12. A railway oar resilient side bearing assembly, according to claim 3, wherein said predetermined cross-sectional shape of said each of said at least one peg means is substantially identical to said predetermined cross-sectional shape of said at least one aperture in said each end of said resilient spring block.

13. A railway car resilient side bearing assembly, according to claim 12, wherein said predetermined cross-sectional shape of each of said at least one peg means and said at least one aperture is generally cylindrical.

14. A railway car resilient side bearing assembly. according to claim 13, wherein a predetermined diameter of said at least one peg means is larger than a predetermined diameter of said at least one aperture thereby providing a predetermined force fit of said at least one peg means into said at least one aperture.

15. A railway car resilient side bearing assembly. according to claim 14, wherein said predetermined force fit is generally between about 175 pounds and about 225 pounds.

16. A railway car resilient side bearing assembly. according to claim 14, wherein said predetermined length of said at least one peg means is longer than said predetermined length of said at least one aperture by a predetermined amount thereby providing an increased pretravel to said resilient side bearing assembly.

17. A railway car resilient side bearing assembly, according to claim 16, wherein said predetermined amount is between about 0.060 inch and about 0.065 inch.

18. A railway car resilient side bearing assembly. according to claim 1, wherein said predetermined portion of said upper surface of said base portion of said housing member is disc-shaped.

19. A railway car resilient side bearing assembly. according to claim 18, wherein said predetermined portion of said lower surface of said plate portion of said friction head member is disc-shaped.

20. A railway car resilient side bearing assembly, according to claim 19, wherein said predetermined portion of each of said upper surface of said base portion of said housing member and said lower surface of said plate portion of said friction head member has a predetermined diameter of between about 1.98 inches and about 2.02 inches.

21. A railway car resilient side bearing assembly, according to claim 20, wherein said predetermined portion of each of said upper surface of said base portion of said housing member and said lower surface of said plate portion of said friction head member is tapered outwardly and downwardly from a center portion at an angle of generally about 5 degrees thereby providing an increased pretravel of said resilient side bearing assembly.

22. A railway car resilient side bearing assembly, according to claim 1, wherein said first portion of said indicator means is a protruding member secured to said plate portion of said friction head member and said second portion of said indicator means is a slot formed in said upstanding body portion of said housing member.

23. A railway car resilient side bearing assembly, according to claim 1 wherein said resilient side bearing assembly further includes a drain means formed in said base portion of said housing member for draining moisture from said cavity in said housing member.

24. A railway car resilient side bearing assembly, according to claim 23, wherein said drain means includes:

(a) at least one aperture formed in said bottom surface of said base portion of said housing member; and (b) at least one channel formed in said bottom surface of said base portion of said housing member, said at least one channel being in fluid communication with said at least one aperture with such truck portion of such railway car.

25. A railway car resilient side bearing assembly, according to claim 1 wherein said substantial portion of said upper friction surface of said plate portion of said friction head member which remains in such frictional engagement with such wear plate during cycling of such truck portion of such railway car is at least about 98 percent thereby providing improved constant rotational torque resistance at a maximum swivel of such truck portion of about 11 degrees during operation of such railway car on a curved portion of track.

26. A railway car resilient side bearing assembly, according to claim 25, wherein said predetermined shape of said upper friction surface of said plate portion of said friction head member is generally rectangular with double tapered end portions having an arcuate end surface adjacent each end.

27. A railway car resilient side bearing assembly, according to claim 1, wherein said reciprocal movement of said downwardly extending rim portion of said friction head member within said cavity in said housing member is between about 0.30 inch and about 0.455 inch from installed height.

28. A railway car resilient side bearing assembly, according to claim 1, wherein said resilient side bearing assembly is securable to such upper surface of such truck portion of such railway car by bolting, and said base portion of said housing member includes at least one aperture adjacent each end to accommodate a bolt shank.

29. A railway car resilient side bearing assembly, according to claim 28, herein said base portion and said upstanding body portion and said at least one peg means substantially perpendicular to and substantially at a geometric center of said upper surface of said base portion and second portion of said indicator means and said at least one aperture adjacent each end of said base member are formed as an integral one-piece casting.

30. A railway car resilient side bearing assembly, according to claim 29, wherein said plate portion and said downwardly extending rim portion and said at least one peg means substantially perpendicular to and at a geometric center of said lower surface of said plate portion and said first portion of said indicator means are formed as an integral one-piece casting.

* * * * *

UNITED STATES PATENT AND TRADEMARK OFFICE

CERTIFICATE OF CORRECTION

PATENT NO. : 4,793,720

DATED : December 27, 1988

INVENTOR(S) : Walter H. Merker, Jr.

It is certified that error appears in the above-identified patent and that said Letters Patent is hereby corrected as shown below:

Column 14, line 45, delete "with such truck portion of such railway car" and insert --formed in said base portion of said housing member--

Column 15, line 9, delete "herein" and insert --wherein--

Signed and Sealed this

Twenty-third Day of May, 1989

*Attest:*

*Attesting Officer*

DONALD J. QUIGG

*Commissioner of Patents and Trademarks*